US011263937B2

(12) United States Patent
Wang et al.

(10) Patent No.: US 11,263,937 B2
(45) Date of Patent: Mar. 1, 2022

(54) PIXEL CIRCUIT, METHOD OF DRIVING THE SAME, AGING DETECTION METHOD AND DISPLAY PANEL

(71) Applicants: HEFEI BOE OPTOELECTRONICS TECHNOLOGY CO., LTD., Anhui (CN); BOE TECHNOLOGY GROUP CO., LTD., Beijing (CN)

(72) Inventors: Ying Wang, Beijing (CN); Hongmin Li, Beijing (CN); Di Wu, Beijing (CN)

(73) Assignees: HEFEI BOE OPTOELECTRONICS TECHNOLOGY CO., LTD., Anhui (CN); BOE TECHNOLOGY GROUP CO.. LTD., Beijing (CN)

( * ) Notice: Subject to any disclaimer, the term of this patent is extended or adjusted under 35 U.S.C. 154(b) by 0 days.

(21) Appl. No.: 17/010,613

(22) Filed: Sep. 2, 2020

(65) Prior Publication Data

US 2021/0125533 A1 Apr. 29, 2021

(30) Foreign Application Priority Data

Oct. 25, 2019 (CN) ..... 201911024820.3

(51) Int. Cl.
*G09G 3/3233* (2016.01)
*G09G 3/00* (2006.01)

(52) U.S. Cl.
CPC ..... *G09G 3/006* (2013.01); *G09G 3/3233* (2013.01); *G09G 2300/0426* (2013.01);
(Continued)

(58) Field of Classification Search
CPC ..... G09G 3/006; G09G 3/3233; G09G 2300/0426; G09G 2310/0202; G09G 2310/08; G09G 2320/045; G09G 2300/0819; G09G 2300/0814; G09G 2300/0842; G09G 3/3208
See application file for complete search history.

(56) References Cited

U.S. PATENT DOCUMENTS 9,972,245 B2 * 5/2018 Wang ..... G09G 3/3233
10,242,625 B2 * 3/2019 Xu ..... G09G 3/3233
(Continued)

FOREIGN PATENT DOCUMENTS

CN 106935192 A * 7/2017 ..... G09G 3/3233

*Primary Examiner* — Jeff Piziali
(74) *Attorney, Agent, or Firm* — Brooks Kushman P.C.

(57) ABSTRACT

A pixel circuit includes a data written-in sub-circuit, a driving sub-circuit, a threshold compensation sub-circuit, a light-emitting element, a sensing sub-circuit and a first light-emission control sub-circuit. The driving sub-circuit is configured to control a driving current for driving the light-emitting element to emit light. The data written-in sub-circuit writes threshold compensation information into a second terminal of the driving sub-circuit at a compensation stage. The threshold compensation sub-circuit stores a data signal and adjusts a voltage at the second terminal of the driving sub-circuit in a coupled manner. The sensing sub-circuit writes a sensing voltage into a first terminal and the second terminal of the driving sub-circuit at a display process, senses aging information of the light-emitting element during an aging detection process and transmits the aging information to the aging detection device.

19 Claims, 6 Drawing Sheets

(52) U.S. Cl.
CPC . *G09G 2310/0202* (2013.01); *G09G 2310/08* (2013.01); *G09G 2320/045* (2013.01)

(56) References Cited

U.S. PATENT DOCUMENTS

| | | | | |
|---|---|---|---|---|
| 2014/0300281 | A1* | 10/2014 | Chaji | G09G 3/3233 315/161 |
| 2015/0243226 | A1* | 8/2015 | Kumeta | G09G 3/3233 345/207 |
| 2015/0348504 | A1* | 12/2015 | Sakariya | G09G 3/2092 345/206 |
| 2016/0104423 | A1* | 4/2016 | Park | G09G 3/3233 345/78 |
| 2016/0189625 | A1* | 6/2016 | Kim | G09G 3/3233 345/205 |
| 2017/0206836 | A1* | 7/2017 | Kim | G09G 3/3233 |
| 2019/0189056 | A1* | 6/2019 | Gai | G09G 3/3258 |
| 2019/0325822 | A1* | 10/2019 | Li | G09G 3/3266 |
| 2020/0005709 | A1* | 1/2020 | Kim | H01L 27/3276 |
| 2020/0051500 | A1* | 2/2020 | Lin | G09G 3/3258 |
| 2021/0125533 | A1* | 4/2021 | Wang | G09G 3/3233 |

* cited by examiner

PIXEL CIRCUIT, METHOD OF DRIVING THE SAME, AGING DETECTION METHOD AND DISPLAY PANEL

CROSS-REFERENCE TO RELATED APPLICATION

This application claims priority to Chinese Patent Application No. 201911024820.3 filed on Oct. 25, 2019, which is incorporated herein by reference in its entirety.

TECHNICAL FIELD

The present disclosure relates to the field of display technology, in particular to a pixel circuit, a method of driving the pixel circuit, an aging detection method and a display panel.

BACKGROUND

An Organic Light-emission Diode (OLED) display panel has drawn widespread attention due to such advantages as lightness and thinness, high brightness, low power consumption, and good flexibility. The OLED display panel may be driven by using an active matrix driving mode or a passive matrix driving mode, where a higher resolution and a display with more colors may be achieved in an active matrix OLED (AMOLED).

SUMMARY

In one aspect, a pixel circuit is provided in some embodiments of the present disclosure, including a data written-in sub-circuit, a driving sub-circuit, a threshold compensation sub-circuit, a light-emitting element, a sensing sub-circuit and a first light-emission control sub-circuit. The driving sub-circuit includes a control terminal, a first terminal and a second terminal, and is configured to control a driving current flowing through the first terminal and the second terminal of the driving sub-circuit for driving the light-emitting element to emit light. The data written-in sub-circuit is connected to a data signal written-in terminal and the control terminal of the driving sub-circuit, and configured to write a reference voltage from the data signal written-in terminal into the control terminal of the driving sub-circuit at a resetting stage of a display process, write threshold compensation information into the second terminal of the driving sub-circuit at a compensation stage of the display process, and write a data signal from the data signal written-in terminal into the control terminal of the driving sub-circuit at a data written-in stage of the display process. The threshold compensation sub-circuit is connected to the control terminal and the second terminal of the driving sub-circuit, and configured to store the data signal and adjust a voltage at the second terminal of the driving sub-circuit in a coupled manner. The light-emitting element includes a first terminal and a second terminal, the first terminal of the light-emitting element is connected to the second terminal of the driving sub-circuit, and the second terminal of the light-emitting element is connected to a second voltage terminal. The sensing sub-circuit is connected to the first terminal of the light-emitting element and an aging detection device in a display panel, and configured to write a sensing voltage into the first terminal and the second terminal of the driving sub-circuit at the resetting stage of the display process, sense aging information of the light-emitting element during an aging detection process and transmit the aging information to the aging detection device. The first light-emission control sub-circuit is connected to a first voltage terminal and the first terminal of the driving sub-circuit, and configured to conduct a connection between the first voltage terminal and the first terminal of the driving sub-circuit at a light-emission stage to write a first voltage into the first terminal of the driving sub-circuit.

In another aspect, a display panel is provided in some embodiments of the present disclosure, including the above-mentioned pixel circuit.

In yet another aspect, a method of driving the above-mentioned pixel circuit is provided in some embodiments of the present disclosure, including: at the resetting stage, applying, by the data written-in sub-circuit, the reference voltage to the control terminal of the driving sub-circuit, and applying, by the sensing sub-circuit, the sensing voltage to the first terminal and the second terminal of the driving sub-circuit; at the compensation stage, applying, by the data written-in sub-circuit, the reference voltage to the control terminal of the driving sub-circuit and writing the threshold compensation information to the second terminal of the driving sub-circuit, and applying, by the first light-emission control sub-circuit, the first voltage from the first voltage terminal to the first terminal of the driving sub-circuit; at the data written-in stage, applying, by the data written-in sub-circuit, the data signal to the control terminal of the driving sub-circuit, and adjusting, by the threshold compensation sub-circuit, the voltage at the second terminal of the driving sub-circuit in accordance with a voltage change amount at the control terminal of the driving sub-circuit in a coupled manner; and at the light-emission stage, turning on the first light-emission control sub-circuit and the driving sub-circuit to apply the driving current to the light-emitting element.

In still yet another aspect, an aging detection method of the above-mentioned pixel circuit is provided in some embodiments of the present disclosure, including: at a resetting stage, writing, by the sensing sub-circuit, a sensing reference voltage applied by an aging sensing device into the second terminal of the driving sub-circuit, and turning on the first light-emission control sub-circuit to write the first voltage into the first terminal of the driving sub-circuit; at a first tracking stage, applying, by the data written-in sub-circuit, the data signal to the control terminal of the driving sub-circuit and write the threshold compensation information into the second electrode of the first thin film transistor, and turning on the first light-emission control sub-circuit to maintain the first terminal of the driving sub-circuit as the first voltage; at a second tracking stage, turning on the first light-emission control sub-circuit to maintain the first terminal of the driving sub-circuit as the first voltage; at a sensing stage, turning on the first light-emission control sub-circuit and the driving sub-circuit to enable the light-emitting element to emit light, and sensing, by the sensing sub-circuit, the aging information of the light-emitting element; at a sampling stage, transmitting, by the sensing sub-circuit, the aging information to the aging detection device; and at a written-back stage, writing, by the data written-in sub-circuit, the reference voltage into the control terminal of the driving sub-circuit, and writing, by the sensing sub-circuit, the sensing reference voltage into the second terminal of the driving sub-circuit.

The additional aspects and advantages of the present disclosure will be given in the following description, and will become apparent from the following description, or be understood through the practice of the present disclosure.

BRIEF DESCRIPTION OF THE DRAWINGS

The above-mentioned and/or additional aspects and advantages of the present disclosure will become apparent and easy to be understood from the following description of the embodiments with reference to the drawings. In these drawings.

DETAILED DESCRIPTION

Figure 1:
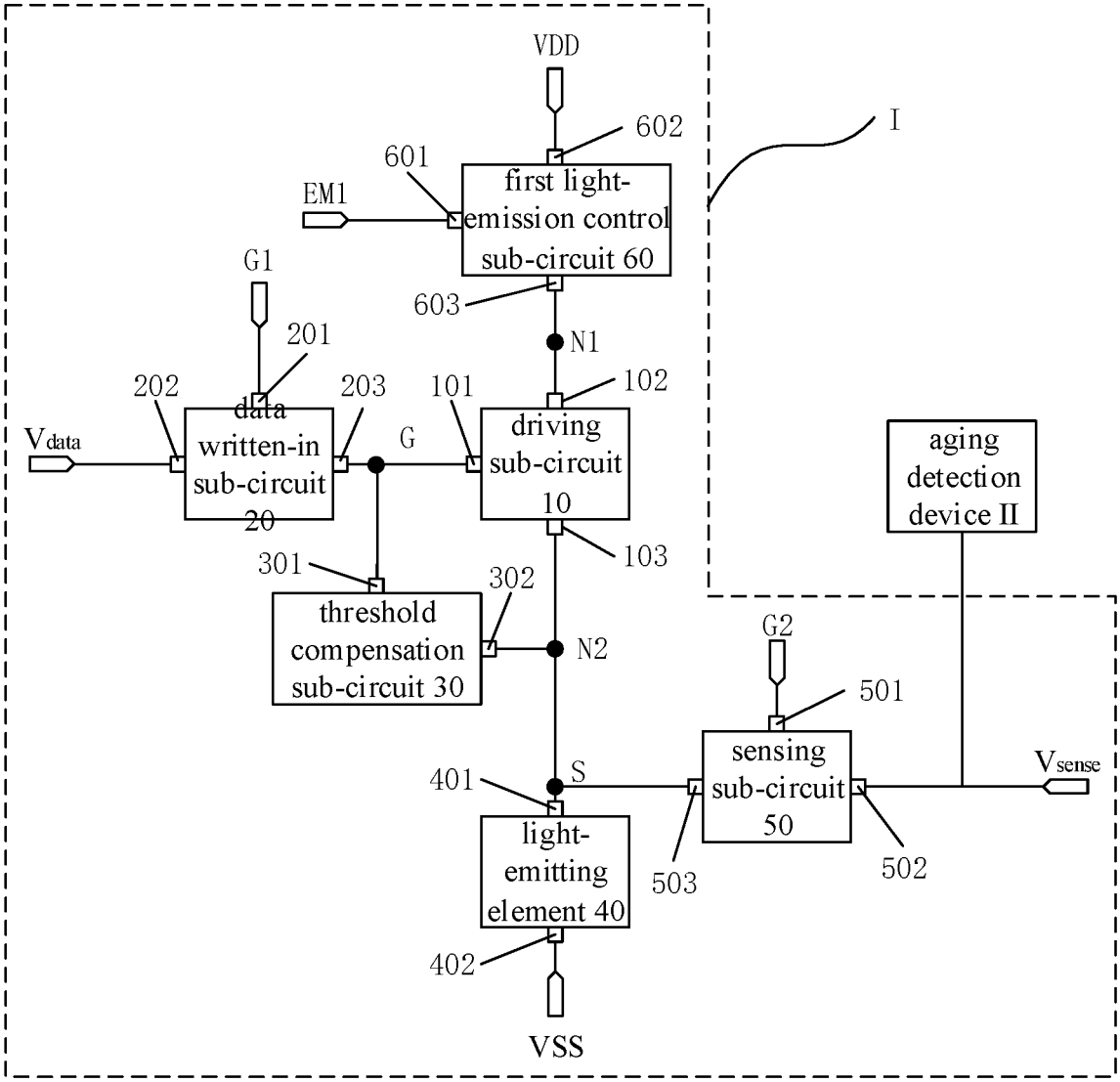
FIG. 1 is a schematic view showing a pixel circuit according to one embodiment of the present disclosure.

The present disclosure will be described in detail hereinafter. The embodiments of the present disclosure are illustrated in the drawings, where a same or similar reference numeral indicates a same or similar component or a component having a same or similar function. In addition, in the case that a detailed description for a known technology is unnecessary for illustrated features of the present disclosure, it will be omitted. The embodiments described below with reference to the drawings are for illustrative purposes only, but shall not be construed as limiting the present disclosure.

A person skilled in the art may understand that, unless defined otherwise, all terms (including technical terms and scientific terms) used herein have the same meaning as those commonly understood by a person of ordinary skill in the art to which the present disclosure belongs. It should also be appreciated that, a term such as defined in a general dictionary should be understood to have the same meaning as that in the context of the prior art, and unless specifically defined, it will not be explained in an idealized or overly formal meaning.

A person skilled in the art may understand that, unless specifically defined, singular forms "a", "an" and "the" used herein may also include plural forms. It should be further appreciated that, a term "include" used in the specification of the present disclosure may referred to as the presence of a feature, an integer, a step, an operation, an element and/or a component, but does not exclude the presence or addition of one or more other features, integers, steps, operations, elements, components and/or groups thereof. It should be appreciated that, when an element is "connected" or "coupled" to another element, it may be directly connected or coupled to another element, or through an intermediate element. In addition, "connected" or "coupled" used herein may include wireless connection or wireless coupling. A term "and/or" used herein includes all or any unit and all combinations of one or more associated listed items.

It has been considered that an OLED pixel circuit include a thin film transistor (TFT), and an offset in performance of the TFT occurs along with the operating time, thus it is necessary to perform a $V_{th}$ compensation on a driving TFT of the pixel circuit. In addition, an aging of an OLED device may also occur along with light-emitting time, which make that the brightness of the OLED device change under an original driving voltage or driving current. Therefore, it is also necessary to detect the aging of the OLED device and perform an aging compensation on the OLED device based on this.

The $V_{th}$ compensation on the driving TFT requires to be performed when a display device displays, so that the driving TFT is independent from a $V_{th}$ drift. The aging compensation on the OLED device is usually performed at the end of the display of the display device, each OLED device is detected to acquire aging information of each OLED device, and each OLED device is compensated based on the aging information. Usually, when the display device is started next time, a data signal of each OLED pixel circuit is adjusted based on the aging information, so as to perform the aging compensation on the OLED device.

Therefore, the $V_{th}$ compensation should be performed in the OLED pixel circuit, and the aging detection of the OLED device should be performed in the OLED pixel circuit together with the aging detection device.

A pixel circuit, a method of driving the pixel circuit, an aging detection method and a display panel in the present disclosure are intended to solve the above technical problems.

A technical solution of the present disclosure and how to solve the above technical problems by using the technical solution of the present disclosure will be described in detail below with specific embodiments.

A pixel circuit is provided in one embodiment, as shown in FIG. 1, a pixel circuit I includes a driving sub-circuit 10, a data written-in sub-circuit 20, a threshold compensation sub-circuit 30, a light-emitting element 40, a sensing sub-circuit 50 and a first light-emission control sub-circuit 60.

The driving sub-circuit 10 includes a control terminal 101, a first terminal 102 and a second terminal 103, and is configured to control a driving current flowing through the first terminal 102 and the second terminal 103 of the driving sub-circuit 10 for driving the light-emitting element 40 to emit light.

The data written-in sub-circuit 20 is connected to a data signal written-in terminal and the control terminal 101 of the driving sub-circuit 10, and configured to write a reference voltage from the data signal written-in terminal into the control terminal 101 of the driving sub-circuit 10 at a resetting stage of a display process, write threshold compensation information into the second terminal 103 of the driving sub-circuit 10 at a compensation stage of the display process, and write a data signal $V_{data}$ from the data signal written-in terminal into the control terminal 101 of the driving sub-circuit 10 at a data written-in stage of the display process.

The threshold compensation sub-circuit 30 is connected to the control terminal 101 and the second terminal 103 of the driving sub-circuit 10, and configured to store the data signal $V_{data}$ and adjust a voltage at the second terminal 103 of the driving sub-circuit 10 in a coupled manner.

The light-emitting element 40 includes a first terminal 401 and a second terminal 402, the first terminal 401 of the light-emitting element 40 is connected to the second terminal 103 of the driving sub-circuit 10, and the second terminal 102 of the light-emitting element 40 is connected to a second voltage terminal VSS.

The sensing sub-circuit 50 is connected to the first terminal 401 of the light-emitting element 40 and an aging detection device II in a display panel, and configured to write a sensing voltage into the first terminal 102 and the second terminal 103 of the driving sub-circuit 10 at the resetting stage of the display process, sense aging information of the light-emitting element 40 during an aging detection process and transmit the aging information to the aging detection device II.

The first light-emission control sub-circuit 60 is connected to a first voltage terminal VDD and the first terminal 102 of the driving sub-circuit 10, and configured to conduct a connection between the first voltage terminal VDD and the first terminal 102 of the driving sub-circuit 10 at a light-emission stage to write a first voltage VGH into the first terminal 102 of the driving sub-circuit 10.

It should be appreciated that, a direct-current (DC) high-level signal may be maintained to be applied to the first voltage terminal VDD in the embodiment of the present disclosure, and the DC high-level signal is the first voltage VGH. A DC low-level signal may be maintained to be applied to the second voltage terminal VSS, the DC low-level signal is a second voltage VGL, and the second voltage VGL is smaller than the first voltage VGH, which is the same as that in the following embodiments and will not be repeated.

To be specific, the light-emitting element 40 is an OLED device, and the OLED device emits light under the control of the driving current.

To be specific, the first light-emission control sub-circuit 60 includes a control terminal 601, a first terminal 602 and a second terminal 603. The control terminal 601 of the first light-emission control sub-circuit 60 is connected to a first light-emission control signal input terminal EM1, the first terminal 602 of the first light-emission control sub-circuit 60 is connected to the first voltage terminal VDD, and the second terminal 603 of the first light-emission control sub-circuit 60 and the first terminal 102 of the driving sub-circuit 10 are connected at a first node N1.

The second terminal 103 of the driving sub-circuit 10 and a second terminal 302 of the threshold compensation sub-circuit 30 are connected at a second node N2.

The data written-in sub-circuit 20 includes a control terminal 201, a first terminal 202 and a second terminal 203. The control terminal 201 of the data written-in sub-circuit 20 is connected to a first scanning signal input terminal G1, the first terminal 202 of the data written-in sub-circuit 20 is connected to the data signal written-in terminal, the second terminal 203 of the data written-in sub-circuit 20, the control terminal 101 of the driving sub-circuit 10 and the first terminal 301 of the threshold compensation sub-circuit 30 are connected at a third node G.

The sensing sub-circuit 50 includes a control terminal 501, a first terminal 502 and a second terminal 503. The control terminal 501 of the sensing sub-circuit 50 is connected to a second scanning signal input terminal G2, the first terminal 502 of the sensing sub-circuit 50 is connected to a sensing signal input terminal, and the second terminal 503 of the sensing sub-circuit 50 and the first terminal 401 of the light-emitting element 40 are connected at a fourth node S.

In the OLED pixel circuit of the embodiment, not only the threshold voltage $V_{th}$ compensation of the driving sub-circuit is performed, but also the aging information detection of the light-emitting element is performed, which facilitates performing the aging compensation on the light-emitting element.

Figure 2:
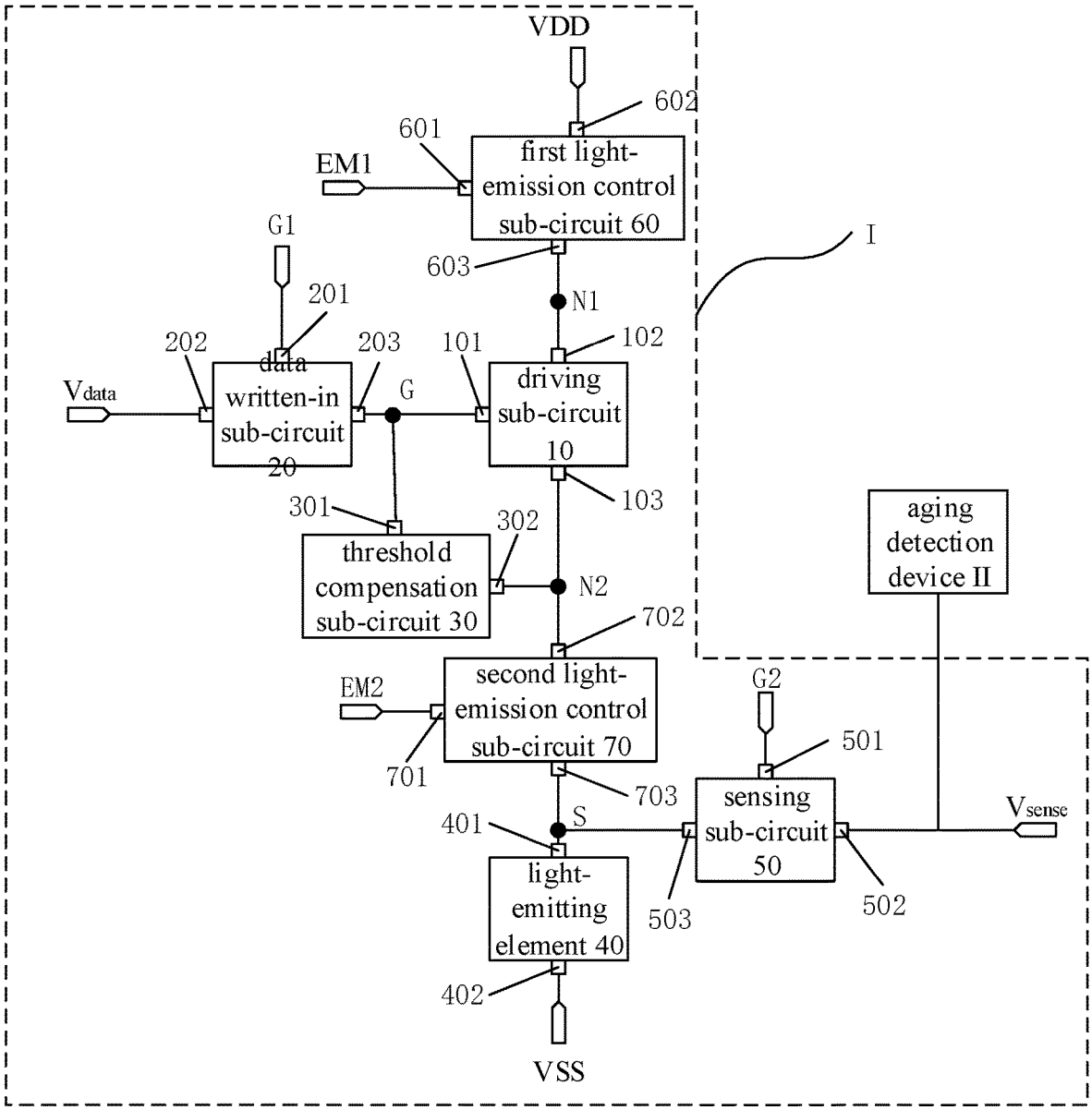
FIG. 2 is another schematic view showing the pixel circuit according to one embodiment of the present disclosure.

Further, a pixel circuit is provided in one embodiment, as shown in FIG. 2, the pixel circuit I further includes a second light-emission control sub-circuit 70 connected to the second terminal 103 of the driving sub-circuit 10 and the first terminal 401 of the light-emitting element 40, and configured to conduct a connection between the second terminal 103 of the driving sub-circuit 10 and the first terminal 401 of the light-emitting element 40 to write the sensing voltage $V_{sense}$ into the first terminal 102 and the second terminal 103 of the driving sub-circuit 10 at the resetting stage of the display process, disconnect the connection between the second terminal 103 of the driving sub-circuit 10 and the first terminal 401 of the light-emitting element 40 to prevent charges at the second terminal 103 of the driving sub-circuit 10 from leaking to the first terminal 401 of the light-emitting element 40 at the compensation stage and the data written-in stage of the display process, and conduct the connection between the second terminal 103 of the driving sub-circuit 10 and the first terminal 401 of the light-emitting element 40 to enable the driving current to flow to the first terminal 401 of the light-emitting element 40 at the light-emission stage of the display process.

To be specific, the second light-emission control sub-circuit 70 includes a control terminal 701, a first terminal 702 and a second terminal 703. The control terminal 701 of the second light-emission control sub-circuit 70 is connected to a second light-emission control signal input terminal EM2, the first terminal 702 of the second light-emission control sub-circuit 70, the second terminal 302 of the threshold compensation sub-circuit 30 and the second terminal 103 of the driving sub-circuit 10 are connected at the second node N2, and the second terminal 703 of the second light-emission control sub-circuit 70, the first terminal 401 of the light-emitting element 40 and the second terminal 503 of the sensing sub-circuit 50 are connected at the fourth node S.

In this embodiment, the second light-emission control sub-circuit 70 is added, and the second light-emission control signal is used to control the second light-emission control sub-circuit 70, it may be ensured that the charges at the second terminal 103 of the driving sub-circuit 10 may not leak to the first terminal 401 of the light-emitting element 40 at the compensation stage and the data written-in stage of the display process, that is, the charges at the second node N2 may not leak to the fourth node S. Thus, the voltage difference $V_{G\text{-}N2}$ between the control terminal 101 (the third node G) of the driving sub-circuit 10 and the second terminal 103 (the second node N2) of the driving sub-circuit 10 is maintained, it is ensured that the light-emitting element 40 may emit light normally at the light-emitting stage, and the display device may display in a normal grayscale. In addition, during the aging detection process, the second light-emission control sub-circuit 70 is disconnected to prevent the charges at the second node N2 from leaking to the fourth node S.

Figure 3:
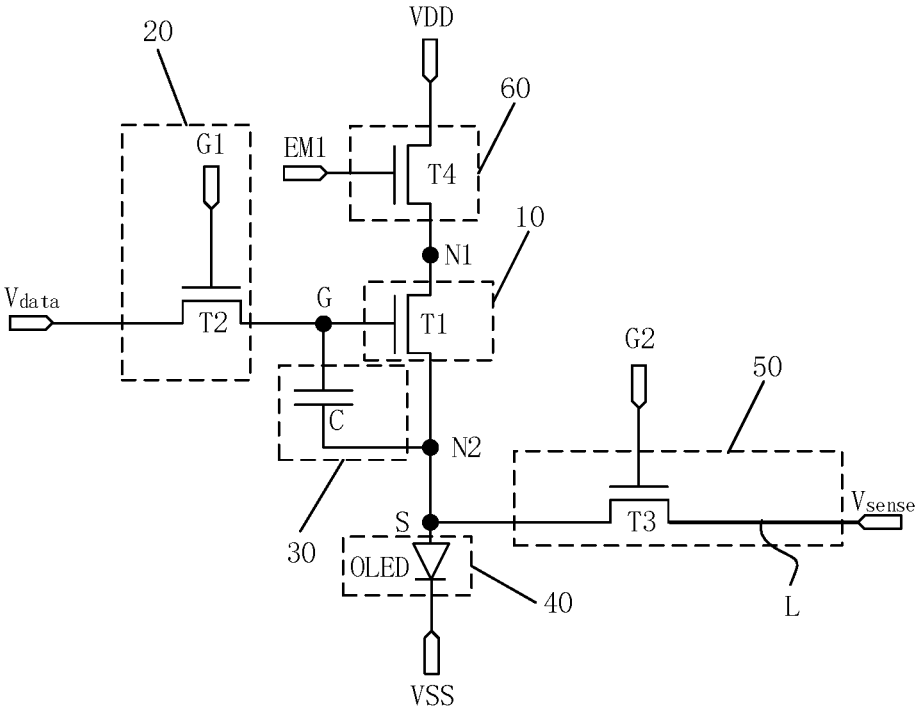
FIG. 3 is a schematic structural view showing an example of a specific implementation of the pixel circuit in FIG. 1.

In the pixel circuit of this embodiment, the pixel circuit shown in FIG. 1 may be specifically implemented as a 4T1C pixel circuit shown in FIG. 3. As shown in FIG. 3, the pixel circuit includes first through fourth thin film transistors, i.e., T1, T2, T3 and T4, a storage capacitor C and the OLED device. In the pixel circuit, the first thin film transistor T1 serves as a driving transistor, and the second through fourth thin film transistors, i.e., T2, T3 and T4, serve as switching transistors. The OLED device used as the light-emitting element may be an OLED device emitting red, green, blue or white light.

In the 4T1C pixel circuit shown in FIG. 3, the $V_{th}$ compensation of the driving TFT (the first thin film transistor T1) may be performed, and the aging information detection of the OLED device may be also performed together with the aging detection device. Further, the 4T1C pixel circuit has a simple structure, and facilitates increasing a resolution of an OLED display device. The 4T1C pixel circuit as shown in FIG. 3 and the method of driving the 4T1C pixel circuit are illustrated below.

As shown in FIG. 3, the driving sub-circuit 10 in the pixel circuit includes a first thin film transistor T1. A gate electrode of the first thin film transistor T1 is the control terminal of the driving sub-circuit 10, a first electrode of the first thin film transistor T1 is the first terminal of the driving sub-circuit 10, and a second electrode of the first thin film transistor T1 is the second terminal of the driving sub-circuit 10. To be specific, the gate electrode of the first thin film transistor T1 is connected to the third node G, the first electrode of the first thin film transistor T1 is connected to the first node N1, and the second electrode of the first thin film transistor T1 is connected to the second node N2.

As shown in FIG. 3, the data written-in sub-circuit 20 in the pixel circuit includes a second thin film transistor T2. A gate electrode of the second thin film transistor T2 is connected to the first scanning signal input terminal G1, a first electrode of the second thin film transistor T2 is connected to the data signal written-in terminal, and a second electrode of the second thin film transistor T2 is connected to the control terminal of the driving sub-circuit 10. To be specific, the gate electrode of the second thin film transistor T2 is connected to the first scanning signal input terminal G1.

As shown in FIG. 3, the sensing sub-circuit 50 in the pixel circuit includes a third thin film transistor T3 and a sensing line L. A gate electrode of the third thin film transistor T3 is connected to the second scanning signal input terminal G2, a first electrode of the third thin film transistor T3 is connected to the sensing signal input terminal through the sensing line L, and a second electrode of the third thin film transistor T3 is connected to the first terminal of the light-emitting element, i.e., to a first electrode of the OLED device. The sensing line L is connected to the aging detection device. To be specific, any point on the sensing line L may be connected to the aging detection device.

As shown in FIG. 3, the threshold compensation sub-circuit in the pixel circuit includes a storage capacitor C. A first electrode of the storage capacitor C is connected to the control terminal of the driving sub-circuit 10, and a second electrode of the storage capacitor C is connected to the second terminal of the driving sub-circuit 10. To be specific, the first electrode of the storage capacitor C is connected to the third node G, and the second electrode of the storage capacitor C is connected to the second node N2. The threshold compensation sub-circuit 30 adjusts the voltage at the second terminal of the driving sub-circuit 10 in a coupled manner through the boosting effect of the storage capacitor C.

As shown in FIG. 3, the first light-emission control sub-circuit 60 in the pixel circuit includes a fourth thin film transistor T4. A gate electrode of the fourth thin film transistor T4 is connected to the first light-emission control signal input terminal EM1, a first electrode of the fourth thin film transistor T4 is connected to the first voltage terminal VDD, and a second electrode of the fourth thin film transistor T4 is connected to the first terminal of the driving sub-circuit 10. To be specific, the second electrode of the fourth thin film transistor T4 is connected to the first node N1.

Figure 5:
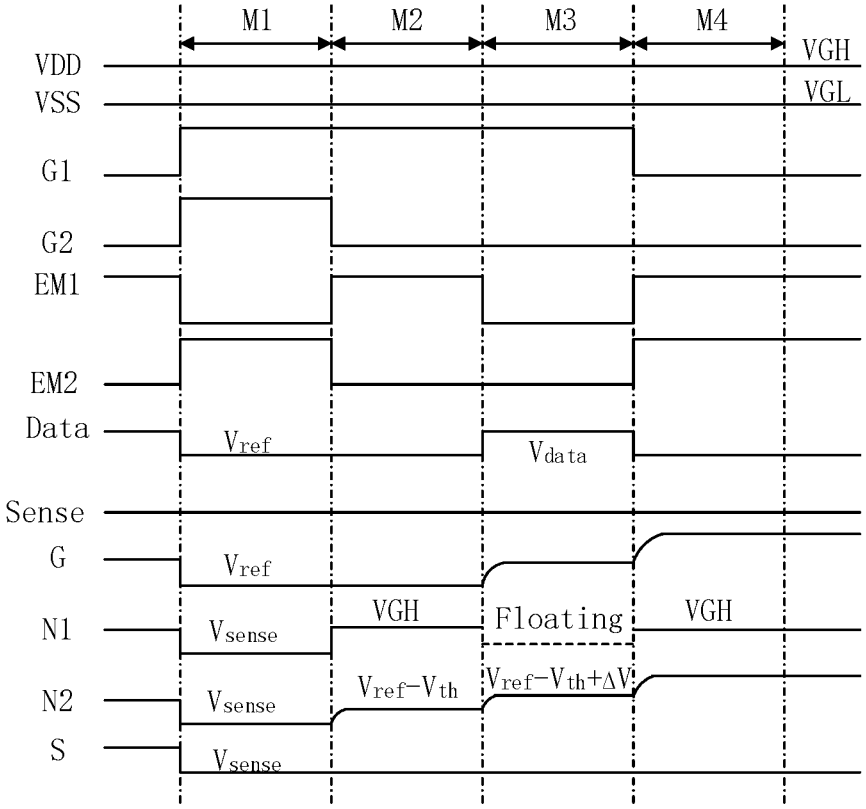
FIG. 5 is a timing sequence diagram of a method of driving the pixel circuit according to one embodiment of the present disclosure.

Please referring to FIG. 3 and FIG. 5, a method of driving the 4T1C pixel circuit is described in detail in the embodiment. A resetting stage M1, a compensation stage M2, a data written-in stage M3 and a light-emission stage are included in the method. In this embodiment, the method of driving the pixel circuit is described by taking that a channel of each thin film transistor is of N-type as an example. It should be appreciated that, the following embodiments are for illustrative purposes only, but shall not be construed as limiting the type of the channel of each thin film transistor. Actually, the channel of each thin film transistor in the pixel circuit may also be of P-type.

As shown in FIG. 3 and FIG. 5, at the resetting stage M1, the data written-in sub-circuit 20 applies the reference voltage $V_{ref}$ to the control terminal (the third node G) of the driving sub-circuit 10, and the sensing sub-circuit 50 applies the sensing voltage $V_{sense}$ to the first terminal (the first node N1) and the second terminal (the second node N2) of the driving sub-circuit 10. At this stage, it is mainly to reset a voltage of each node. Usually, the voltage of each node is reset to be at a lower level. According to different application scenarios of the pixel circuit, it may be reset to be at a different level.

To be specific, a high level is applied to the first scanning signal input terminal G1 (the gate electrode of the second thin film transistor T2), and a reference voltage $V_{ref}$ is applied to the data signal written-in terminal. Since $V_{ref}$ is a low level, the second thin film transistor T2 is turned on, so that the reference voltage $V_{ref}$ is written into the third node G, that is, the voltage at the gate electrode of the first thin film transistor T1 is $V_{ref}$.

A high level is applied to the second scanning signal input terminal G2 (the gate electrode of the third thin film transistor T3), and the sensing voltage $V_{sense}$ is applied to the sensing signal input terminal, so that the third thin film transistor T3 is turned on, and the sensing voltage $V_{sense}$ is written into the second node N2, that is, a voltage at a source electrode of the first thin film transistor T1 is $V_{sense}$.

The reference voltage $V_{ref}$ is set to be larger than the sensing voltage $V_{sense}$, and a difference between the reference voltage $V_{ref}$ and the sensing voltage $V_{sense}$ may enable the first thin film transistor T1 to be turned on, then the sensing voltage $V_{sense}$ is written to the first terminal of the driving sub-circuit 10, i.e., the first node N1.

In addition, when a low level is applied to the first light-emission control signal input terminal EM1 (the gate electrode of the fourth thin film transistor T4), the fourth thin film transistor T4 is in an off state.

Therefore, at the resetting stage, a voltage $V_{N2}$ at the second node N2 is $V_{sense}$, a voltage $V_G$ at the third node G is $V_{ref}$, and a voltage $V_S$ of the fourth node S is $V_{sense}$.

As shown in FIG. 3 and FIG. 5, at the compensation stage M2, the data written-in sub-circuit 20 applies the reference voltage $V_{ref}$ to the control terminal of the driving sub-circuit 10 and writes the threshold compensation information to the second terminal of the driving sub-circuit 10. The first light-emission control sub-circuit 60 applies the first voltage VGH from the first voltage terminal VDD to the first terminal of the driving sub-circuit 10.

To be specific, a high level is applied to the first scanning signal input terminal G1 (the gate electrode of the second thin film transistor T2), the reference voltage $V_{ref}$ is applied to the data signal written-in terminal, and the second thin film transistor T2 is turned on, so that the reference voltage $V_{ref}$ is written into the third node G, that is, a voltage at the gate electrode of the first thin film transistor T1 is $V_{ref}$.

In addition, a low level is applied to the second scanning signal input terminal G2 (the gate electrode of the third thin film transistor T3), the sensing voltage $V_{sense}$ is applied to the sensing signal input terminal, and the third thin film transistor T3 is in an off state.

A high level is applied to the first light-emission control signal input terminal EM1 to turn on the fourth thin film transistor T4, so that the first voltage VGH from the first voltage terminal VDD is written into the first electrode (the first node N1) of the first thin film transistor T1.

Therefore, the first thin film transistor T1 is in an off state, and the first thin film transistor T1 is a TFT of a depletion type. In the off state, the gate-to-source voltage difference $V_{G-N2}$ of the first thin film transistor T1 is Var. Because the voltage $V_G$ at the third node G at this stage is maintained as the reference voltage $V_{ref}$, $V_{N2}=V_G-V_{th}=V_{ref}-V_{th}$. That is, $V_{th}$ is written into the second terminal of the first thin film transistor T1, which means that the threshold compensation information is written into the second terminal of the driving sub-circuit 10.

As shown in FIG. 3 and FIG. 5, at the data written-in stage M3, the data written-in sub-circuit 20 applies the data signal $V_{data}$ to the control terminal of the driving sub-circuit 10, and the threshold compensation sub-circuit 30 adjusts the voltage at the second terminal of the driving sub-circuit 10 in accordance with a voltage change amount at the control terminal of the driving sub-circuit 10 in a coupled manner.

To be specific, a high level is applied to the first scanning signal input terminal G1 (the gate electrode of the second thin film transistor T2), and a data signal $V_{data}$ is applied to the data signal written-in terminal, so that the second thin film transistor T2 is turned on, and the data signal $V_{data}$ is applied to the third node G, that is, the voltage at the gate electrode of the first thin film transistor T1 is $V_{data}$.

In addition, a low level is applied to the second scanning signal input terminal G2, and a sensing voltage $V_{sense}$ is applied to the sensing signal input terminal, so that the third thin film transistor T3 is turned off. A low level is applied to the first light-emission control signal input terminal EM1 to turn off the fourth thin film transistor T4.

Therefore, the voltage at the second node N2, i.e., the second electrode (the source electrode) of the first thin film transistor T1, is increased to $V_{ref}-V_{th}+\Delta V$ through the boosting effect of the storage capacitor C, and a difference between a voltage of the gate electrode and a voltage of the source electrode of the first thin film transistor T1, i.e., $V_{G-N2}=V_{data}-(V_{ref}-V_{th}+\Delta V)=V_{data}-V_{ref}+V_{th}-\Delta V$, where $\Delta V$ is an increment in voltage at the second node N2 raised by the boosting effect of the storage capacitor C at this stage.

As shown in FIG. 3 and FIG. 5, at the light-emission stage M4, the first light-emission control sub-circuit 60 and the driving sub-circuit 10 are connected to apply the driving current to the light-emitting element 40.

To be specific, a high level is applied to the first light-emission control signal input terminal EM1 to turn on the fourth thin film transistor T4, so that the voltage of the first node N1 is the first voltage VGH, the difference between the voltage of the gate electrode and the voltage of the source electrode of the first thin film transistor T1, i.e., $V_{G-N2}$, remains unchanged at this stage, and the first thin film transistor T1 is turned on.

In addition, a low level is applied to both the first scanning signal input terminal G1 and the second scanning signal input terminal G2, so that both the second thin film transistor T2 and the third thin film transistor T3 are turned off.

At this time, the light-emitting element 40, i.e., the OLED device, emits light under the driving current $I_{drive}$, and the driving current $I_{drive}$ may be calculated by using the following formula:

$$\begin{aligned} I_{drive} &= \frac{\mu}{2} * \frac{W}{L}(V_{gate\ electrode-source\ electrode} - V_{th})^2 \\ &= \frac{\mu}{2} * \frac{W}{L}(V_{G-N2} - V_{th})^2 \\ &= \frac{\mu}{2} * \frac{W}{L}(V_{data} - V_{ref} + V_{th} - \Delta V - V_{th})^2 \\ &= \frac{\mu}{2} * \frac{W}{L}(V_{data} - V_{ref} - \Delta V)^2 \end{aligned}$$

In the above formula, "μ" is a mobility of a carrier in the first thin film transistor T1, and $$\text{“}\frac{W}{L}\text{”}$$

is a width-to-length ratio of a channel in the first thin film transistor T1.

It may be seen from the above formula that at the light-emission stage M4, the driving current $I_{drive}$ is independent from the threshold voltage $V_{th}$ of the first thin film transistor T1, that is, when the 4T1C pixel circuit is driven in accordance with the timing sequence shown in FIG. 5, the threshold voltage $V_{th}$ compensation on the driving TFT (the first thin film transistor T1) is performed.

Figure 4:
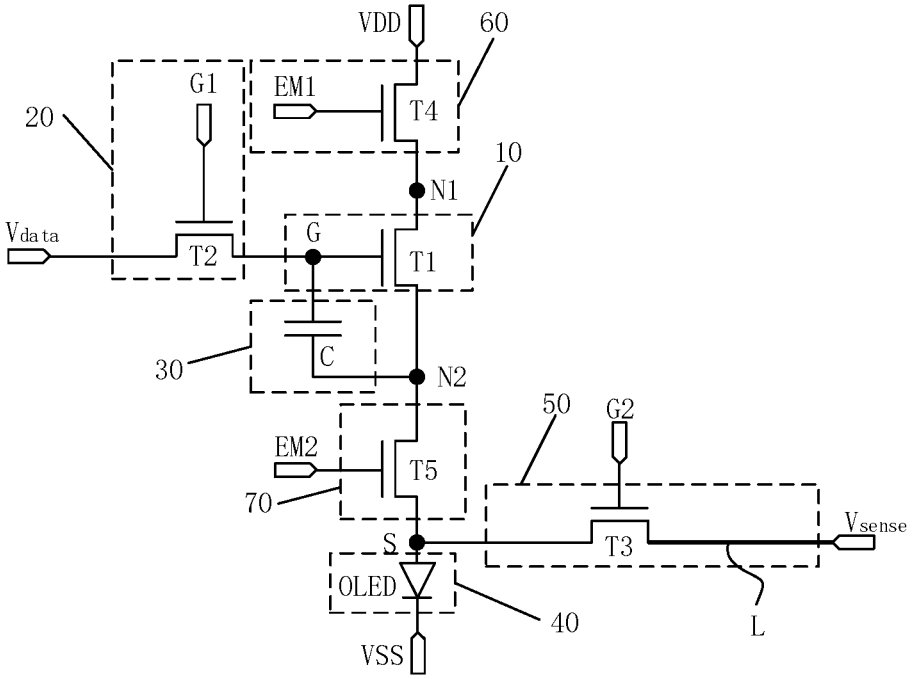
FIG. 4 is a schematic structural view showing an example of a specific implementation of the pixel circuit in FIG. 2.

In the pixel circuit of the embodiment, the pixel circuit shown in FIG. 2 may be specifically implemented as a 5T1C pixel circuit shown in FIG. 4. As shown in FIG. 4, the pixel circuit includes the first through fifth thin film transistors, i.e., T1, T2, T3, T4 and T5, the storage capacitor C and the OLED device. In the pixel circuit, the first thin film transistor T1 serves as a driving transistor, and the second through fifth thin film transistors, i.e., T2, T3, T4, and T5, serve as switching transistors. Functions and timing sequences of the first through fourth thin film transistors, i.e., T1, T2, T3, and T4, are the same as those in the pixel circuit shown in FIG. 3, and will not be repeated in this embodiment.

The 5T1C pixel circuit shown in FIG. 4 and the method of driving the same with reference to the 5T1C pixel circuit will be described in detail hereinafter.

As shown in FIG. 4, the second light-emission control sub-circuit 70 in the pixel circuit includes a fifth thin film transistor T5. A gate electrode of the fifth thin film transistor T5 is connected to the second light-emission control signal input terminal EM2, a first electrode of the fifth thin film transistor T5 is connected to the first terminal of the driving sub-circuit 10, and a second electrode of the fifth thin film transistor T5 is connected to the first terminal of the light-emitting element 40. To be specific, the first electrode of the fifth thin film transistor T5 is connected to the second node N2, and the second electrode of the fifth thin film transistor T5 is connected to the fourth node S.

Please referring to FIG. 4 and FIG. 5, the method of driving the pixel circuit in the embodiment further includes: at the resetting stage M1, the second light-emission control sub-circuit 70 is turned on to write the sensing voltage $V_{sense}$ into the second terminal of the driving sub-circuit 10. To be specific, a high level is applied to the second light-emission control signal input terminal EM2. Since the voltage at the fourth node S is the sensing voltage $V_{sense}$, the fifth thin film transistor T5 is turned on, so that the sensing voltage $V_{sense}$ is written to the second node N2, that is, the sensing voltage $V_{sense}$ is written into the second terminal of the driving sub-circuit 10.

At the compensation stage M2 and the data written-in stage M3, the second light-emission control sub-circuit 70 is turned off to prevent charges at the second terminal of the driving sub-circuit 10 from leaking to the first terminal of the light-emitting element 40. To be specific, a low level is applied to the second light-emission control signal input terminal EM2 to turn off the fifth thin film transistor T5, thereby breaking a connection between the second node N2 and the fourth node S to prevent charges at the second node N2 from leaking to the fourth node S, i.e., to prevent the charges at the second terminal of the driving sub-circuit 10 from leaking to the first terminal of the light-emitting element 40.

At the light-emission stage M4, the second light-emission control sub-circuit 70 is turned on to apply the driving current to the light-emitting element 40. To be specific, a high level is applied to the second light-emission control signal input terminal EM2 to conduct the connection between the second node N2 and the fourth node S, that is, to conduct the connection between the second terminal of the first thin film transistor T1 and the first terminal of the light-emitting element 40, thereby applying the driving current to the OLED device.

In the 5T1C pixel circuit shown in FIG. 4, the threshold voltage $V_{th}$ compensation on the driving TFT (the first thin film transistor T1) may be performed, and the aging information detection of the OLED device may be also performed together with the aging detection device. The 5T1C pixel circuit has a simple structure, and facilitates increasing a resolution of an OLED display device. In addition, the fifth thin film transistor T5 may be turned off at the compensation stage and the data written-in stage, so that the charges at the second node N2 may not leak to the fourth node S, the voltage difference $V_{G\text{-}N2}$ between the third node G and the fourth node S is maintained, it is ensured that the light-emitting element 40 may emit light normally at the light-emitting stage, and the display device may display in a normal grayscale, which improves the display effect.

Figure 6:
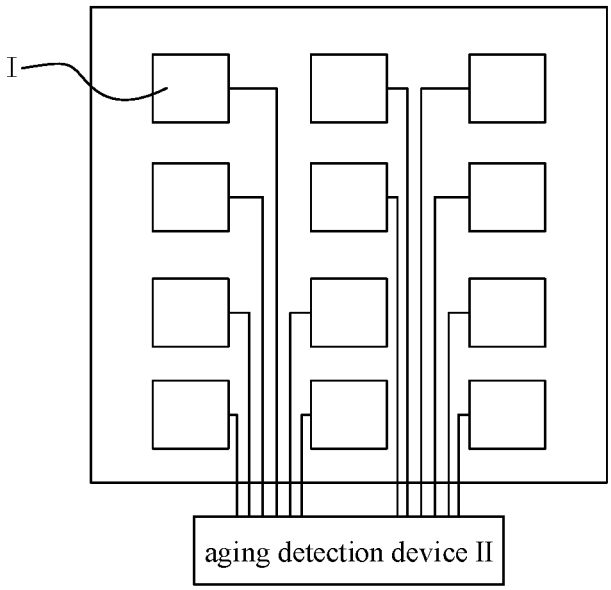
FIG. 6 is a schematic view showing a display panel according to one embodiment of the present disclosure.

Based on the same invention concept, a display panel is provided in the embodiment. As shown in FIG. 6, the display panel includes the pixel circuit I in the above embodiment, has the beneficial effects in the above embodiment, and will not be repeated herein.

Further, the display panel in this embodiment further includes the aging detection device II connected to the pixel circuit I. To be specific, a plurality of pixel circuits I are usually connected to a same aging detection device II.

Figure 7:
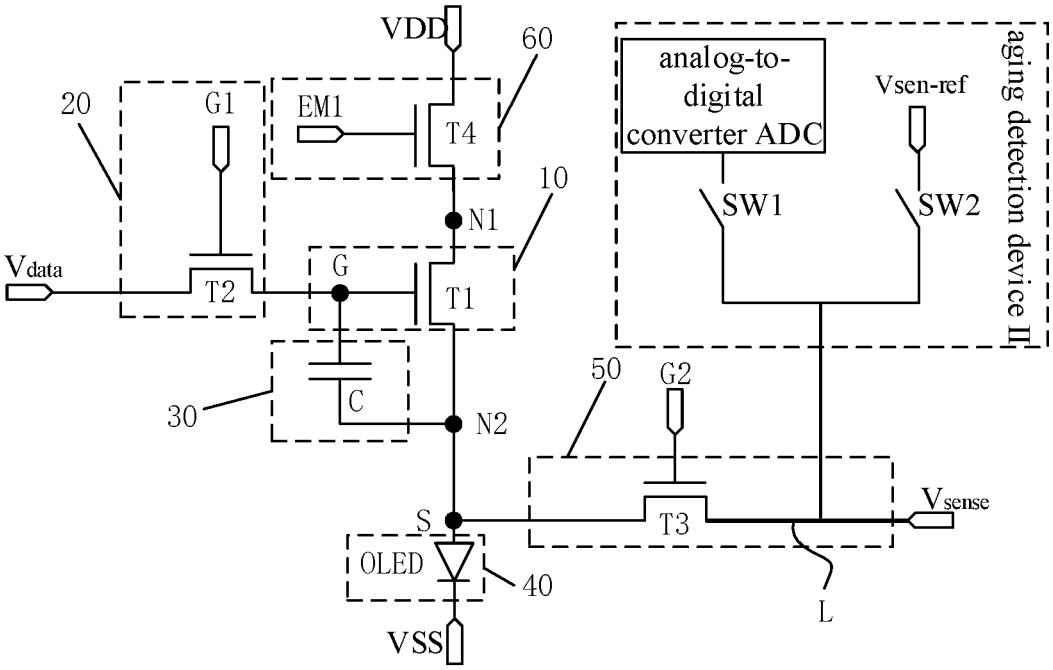
FIG. 7 is a schematic view showing a connection between the pixel circuit and an aging detection device according to one embodiment of the present disclosure.
Figure 8:
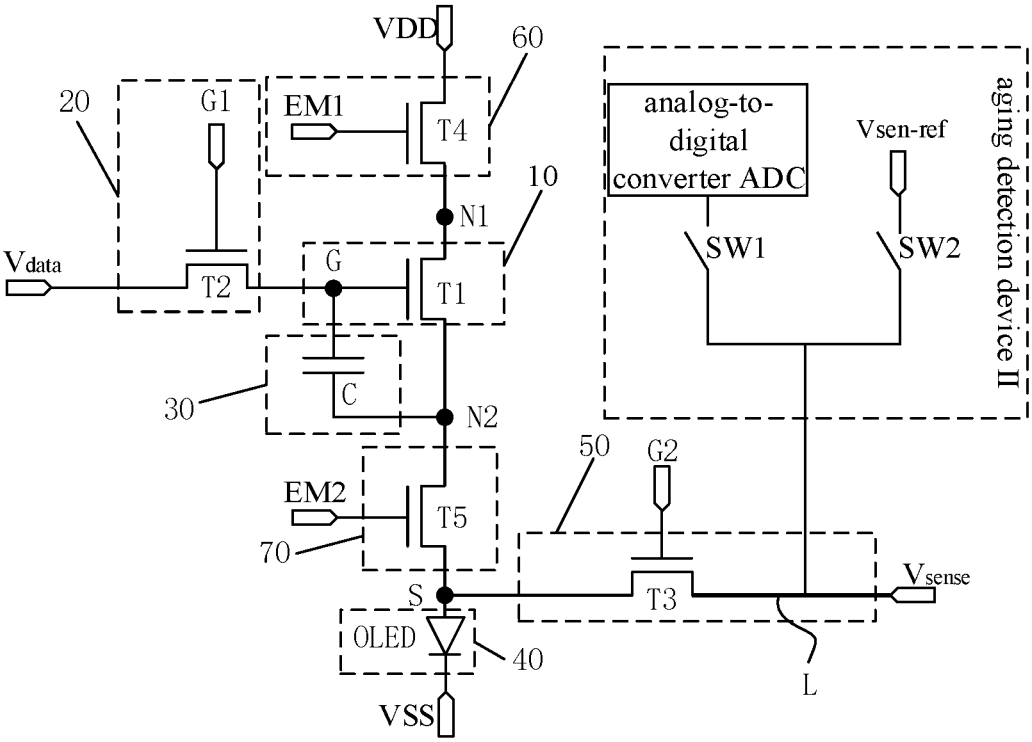
FIG. 8 is another schematic view showing the connection between the pixel circuit and the aging detection device according to one embodiment of the present disclosure.

In a possible embodiment of the present disclosure, as shown in FIG. 7 or FIG. 8, the aging detection device includes an analog-to-digital converter ADC, a sensing resetting signal input terminal, a first switch tube SW1 and a second switch tube SW2. The analog-to-digital converter ADC is connected to the sensing sub-circuit 50 through the first switch tube SW1, and configured to receive the aging information when the first switch tube SW1 is turned on. The sensing resetting signal input terminal is connected to the sensing sub-circuit 50 through the second switch tube SW2, and configured to write a sensing reference voltage $V_{sen\text{-}ref}$ into the sensing sub-circuit 50 when the second switch tube SW2 is turned on. In specific, the aging detection device II is connected to any point in the sensing line L.

Based on the same invention concept, an aging detection method of the pixel circuit is provided in the embodiment. The connection between the pixel circuit I and the aging detection device II shown in FIG. 1 may be specifically implemented as the connection between the 4T1C pixel circuit and the aging detection device II shown in FIG. 7. The aging detection method of the 4T1C pixel circuit shown in FIG. 7 will be described in detail below in conjunction with the timing sequence diagram of the aging detection method shown in FIG. 9.

The aging detection method in the embodiment includes a resetting stage D1, a first tracking stage D2, a second tracking stage D3, a sensing stage D4, a sampling stage D5 and a written-back stage D6. In this embodiment, the aging detection method of the pixel circuit is described by taking that a channel of each thin film transistor is of N-type as an example. It should be appreciated that, the following embodiments are for illustrative purposes only, but shall not be construed as limiting the type of the channel of each thin film transistor. Actually, the channel of each thin film transistor in the pixel circuit may also be of P-type.

Figure 9:
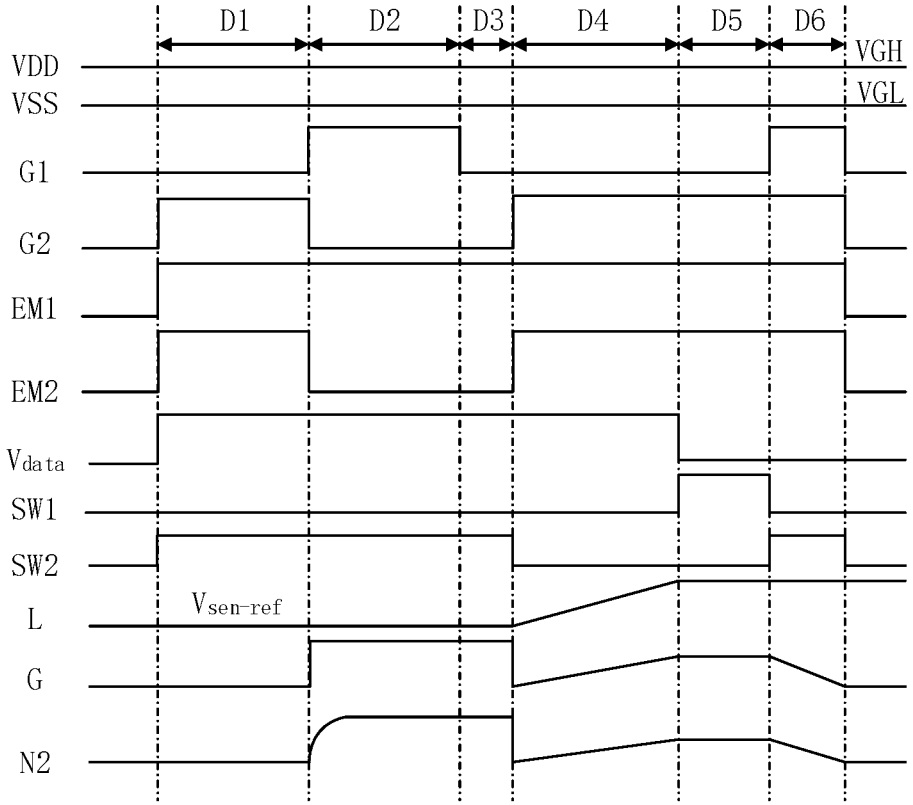
FIG. 9 is a timing sequence diagram of an aging detection method of the pixel circuit according to one embodiment of the present disclosure.

As shown in FIG. 7 and FIG. 9, at the resetting stage D1, the sensing sub-circuit 50 writes a sensing reference voltage $V_{sen\text{-}ref}$ applied by the aging sensing device II into the second terminal of the driving sub-circuit 10, and the first light-emission control sub-circuit 60 is turned on to write the first voltage VGH into the first terminal of the driving sub-circuit 10.

To be specific, a low level is applied to a control terminal of the first switch tube SW1 to turn off the first switch tube SW1, and a high level is applied to a control terminal of the second switch tube SW2 to turn on the second switch tube SW2, thereby applying the sensing reference voltage $V_{sen\text{-}ref}$ to the sensing sub-circuit 50. A high level is applied to the second scanning signal input terminal G2 to turn on the third thin film transistor T3, and the sensing reference voltage $V_{sen\text{-}ref}$ is written into the second node N2, i.e., into the second terminal of the driving sub-circuit 10.

At the same time, a high level is applied to the first light-emission control signal input terminal EM1, so that the fourth thin film transistor T4 is turned on to write the first voltage VGH into the first terminal of the driving sub-circuit 10.

In addition, a low level is applied to the first scanning signal input terminal G1 to turn off the second thin film transistor T2.

At this stage, a voltage on the sensing line L is the sensing reference voltage $V_{sen\text{-}ref}$, the voltage $V_{N1}$ at the first node N1 is the first voltage VGH, and the voltage $V_{N2}$ at the second node N2 is $V_{sen\text{-}ref}$.

It should be appreciated that, although the control terminals of the first switch tube SW1 and the second switch tube SW2 are not shown in FIG. 7 or FIG. 8, the first switch tube SW1 and the second switch tube SW2 may actually be thin film transistors, and gate electrodes of the thin film transistor may be used as the control terminals of the first switch tube SW1 and the second switch tube SW2.

As shown in FIG. 7 and FIG. 9, at the first tracking stage D2, the data written-in sub-circuit 20 applies the data signal to the control terminal of the driving sub-circuit 10 and writes the threshold compensation information into the second terminal of the driving sub-circuit. The first light-emission control sub-circuit 60 is turned on to maintain the first terminal of the driving sub-circuit 10 at the first voltage VGH.

To be specific, a high level is applied to the first scanning signal input terminal G1, and the data signal $V_{data}$ is applied to the data signal written-in terminal, and the second thin film transistor T2 is turned on to write the data signal $V_{data}$ to the third node G, that is, the voltage at the gate electrode of the first thin film transistor T1 is $V_{data}$.

At the same time, a high level is applied to the first light-emission control signal input terminal EM1 to turn on the fourth thin film transistor T4, so that the voltage at the first node is maintained as the first voltage VGH, that is, the voltage at the first terminal of the driving sub-circuit 10 is maintained as the first voltage VGH.

In addition, when a low level is applied to the second scanning signal input terminal G2 (the gate electrode of the third thin film transistor T3), the third thin film transistor T3 is in an off state.

At this stage, the voltage on the sensing line L is still the sensing reference voltage $V_{sen-ref}$, the voltage $V_G$ at the third node G is $V_{data}$, the voltage $V_{N1}$ at the first node N1 is VGH, and the voltage $V_{N2}$ at the second node N2 is $V_{data}-V_{th}$, which means that $V_{th}$ is written to the second terminal of the first thin film transistor T1, that is, the threshold compensation information is written to the second terminal of the driving sub-circuit 10.

As shown in FIG. 7 and FIG. 9, at the second tracking stage D3, the first light-emission control sub-circuit 60 is turned on to maintain the voltage at the first terminal of the driving sub-circuit 10 at the first voltage VGH.

To be specific, a high level is applied to the first light-emission control signal input terminal EM1 to turn on the fourth thin film transistor T4, so that the voltage at the first node N1 is maintained at the first voltage VGH, that is, the voltage at the first terminal of the driving sub-circuit 10 is maintained at the first voltage VGH.

At this stage, the voltage on the sensing line L is still the sensing reference voltage $V_{sen-ref}$, the voltage $V_G$ at the third node G is $V_{data}$, the voltage $V_{N1}$ at the first node N1 is VGH, and the voltage $V_{N2}$ at the second node N2 is $V_{data}-V_{th}$.

As shown in FIG. 7 and FIG. 9, at a sensing stage D4, the first light-emission control sub-circuit 60 and the driving sub-circuit 10 are turned on to enable the light-emitting element 40 to emit light, and the sensing sub-circuit 50 senses the aging information of the light-emitting element 40.

To be specific, a high level is applied to the first light-emission control signal input terminal EM1 to turn on the fourth thin film transistor T4, so that the voltage of the first node N1 is maintained at the first voltage VGH, that is, the voltage at the first terminal of the driving sub-circuit 10 is maintained at the first voltage VGH. The gate-to-source voltage difference $V_{G-N2}$ of the first thin film transistor T1 remains unchanged, and the first thin film transistor T1 is still in an on state, that is, the light-emitting element 40 still emits light under the control of the driving current.

At the same time, a high level is applied to the second scanning signal input terminal G2 to turn on the third thin film transistor T3, so that the sensing line L is charged from the second electrode of the first thin film transistor T1, i.e., the second node N2, the voltage on the sensing line L is pulled up, and the voltages at the second node N2 and the third node G are pulled down, as shown in FIG. 9. Charge capacities that may be charged into the sensing line L are different due to different aging degrees of the light-emitting element 40, i.e., the OLED device, so that the voltages on the sensing line L, i.e., the aging information of the light-emitting element 40 sensed by the sensing sub-circuit 50, are different.

At this stage, a low level is applied to both the control terminal of the first switch tube SW1 and the control terminal of the second switch tube SW2 to turn off the first switch tube SW1 and the second switch tube SW2, thereby preventing charges on the sensing line L from leaking into the aging detection device II at the sensing stage D4.

As shown in FIG. 7 and FIG. 9, at the sampling stage D5, the sensing sub-circuit 50 transmits the aging information to the aging detection device II.

To be specific, a high level is applied to the control terminal of the first switch tube SW1 to turn on the first switch tube SW1, a low level is applied to the control terminal of the second switch tube SW2 to turn off the second switch tube SW2, and the voltage on the sensing line L is sampled by the analog-to-digital converter ADC.

At the same time, a high level is applied to the second scanning signal input terminal G2, a high level is applied to the first light-emission control signal input terminal EM1, so that the first thin film transistor T1, the third thin film transistor T3 and the fourth thin film transistor T4 are all turned on. That is, the OLED device continues to emit light at this stage, so as to ensure that the voltage on the sensing line L is maintained at a constant value, thereby ensuring the accuracy of a sampling result of the analog-to-digital converter ADC.

As shown in FIG. 7 and FIG. 9, at the written-back stage D6, the data written-in sub-circuit 20 writes the reference voltage $V_{ref}$ into the control terminal of the driving sub-circuit 10, and the sensing sub-circuit 50 writes the sensing reference voltage $V_{sen-ref}$ into the second terminal of the driving sub-circuit 10.

To be specific, a high level is applied to the first scanning signal input terminal G1, the reference voltage $V_{ref}$ is applied to the data signal written-in terminal, and the second thin film transistor T2 is turned on, so that the reference voltage $V_{ref}$ is written to the third node G, which means that the voltage at the gate electrode of the first thin film transistor T1 is $V_{ref}$, that is, the reference voltage $V_{ref}$ is written into the control terminal of the driving sub-circuit 10.

A high level is applied to the second scanning signal input terminal G2, the sensing reference voltage $V_{sen-ref}$ is applied to the sensing resetting signal input terminal, and the third thin film transistor T3 is turned on. At the same time, a high level is applied to the control terminal of the second switch tube SW2 to turn on the second switch tube SW2, thereby writing the sensing reference voltage $V_{sen-ref}$ into the second node N2, i.e., writing the sensing reference voltage $V_{sen-ref}$ into the second terminal of the driving sub-circuit 10.

In addition, a high level is applied to the first light-emission control signal input terminal EM1, and the fourth transistor T4 is in an on state. The gate-to-source voltage difference $V_{G-N2}$ of the first thin film transistor T1 remains unchanged, and the first thin film transistor T1 is still in an on state. And a low level is applied to the control terminal of the first switch tube SW1 to turn off the first switch tube SW1.

At this stage, the voltage $V_{N2}$ at the second node N2 is $V_{sen-ref}$, the voltage $V_G$ at the third node G is $V_{ref}$, the voltage $V_S$ at the fourth node S is $V_{sen-ref}$.

The connection between the pixel circuit I and the aging detection device II shown in FIG. 2 may be specifically implemented as the connection between the 5T1C pixel circuit and the aging detection device II shown in FIG. 8. The aging detection method of the 5T1C pixel circuit shown in FIG. 8 will be described in detail below in conjunction with the timing sequence diagram of the aging detection method shown in FIG. 9.

The aging detection method in the embodiment includes a resetting stage D1, a first tracking stage D2, a second tracking stage D3, a sensing stage D4, a sampling stage D5 and a written-back stage D6. In this embodiment, the aging detection method of the pixel circuit is described by taking that a channel of each thin film transistor is of N-type as an example. It should be noted that, the following embodiments are for illustrative purposes only, but shall not be construed as limiting the type of the channel of each thin film transistor. Actually, the channel of each thin film transistor in the pixel circuit may also be of P-type.

Functions and timing sequences of the first through fourth thin film transistors, i.e., T1, T2, T3, and T4, and the aging detection device in the aging detection method are the same as those in the aging detection method of the pixel circuit shown in FIG. 7, and will not be repeated in this embodiment.

As shown in FIG. 7 and FIG. 9, the aging detection method in the embodiment further includes: at the resetting stage D1, the second light-emission control sub-circuit 70 is turned on to enable the sensing sub-circuit 50 to write the sensing reference voltage $V_{sen-ref}$ applied by the aging sensing device II into the second terminal of the driving sub-circuit 10. To be specific, a high level is applied to the second light-emission control signal input terminal EM2 to turn on the fifth thin film transistor T5, thereby conducting the connection between the second node N2 and the fourth node S, writing the sensing reference voltage $V_{sen-ref}$ into the second node N2, that is, writing the sensing reference voltage $V_{sen-ref}$ into the second terminal of the driving sub-circuit 10.

At the first tracking stage D2 and second tracking stage D3, the second light-emission control sub-circuit 70 is turned off to prevent charges at the second terminal of the driving sub-circuit 10 from leaking to the first terminal of the light-emitting element 40. To be specific, a low level is applied to the second light-emission control signal input terminal EM2 to turn off the fifth thin film transistor T5, thereby disconnecting the second node N2 from the fourth node S to prevent charges at the second node N2 from leaking to the fourth node S, that is, to prevent the charges at the second terminal of the driving sub-circuit 10 from leaking to the first terminal of the light-emitting element 40.

At the sensing stage D4, the second light-emission control sub-circuit 70 is turned on to enable the light-emitting element 40 to emit light, and the sensing sub-circuit 50 senses the aging information of the light-emitting element 40. To be specific, a high level is applied to the second light-emission control signal input terminal EM2 to turn on the fifth thin film transistor T5, thereby conducting the connection between the second node N2 and the fourth node S. Then the driving current may flow into the light-emitting element 40, the sensing line may be charged by the charges at the second node, and the sensing sub-circuit 50 may sense the aging information of the light-emitting element 40.

At the sampling stage D5, the second light-emission control sub-circuit 70 is turned on to enable the light-emitting element 40 to emit light, and the sensing sub-circuit 50 transmits the aging information to the aging detection device II. To be specific, a high level is applied to the second light-emission control signal input terminal EM2 to turn on the fifth thin film transistor T5, thereby conducting the connection between the second node N2 and the fourth node S. Then the driving current may flow into the light-emitting element 40, the sensing line may be continued to be charged by the second node N2 at this stage to maintain the voltage on the sensing line L and ensure that the aging information may be transmitted to the aging detection device II.

At the written-back stage D6, the second light-emission control sub-circuit 70 is turned on to enable the sensing sub-circuit 50 to write the sensing reference voltage $V_{sen-ref}$ into the second terminal of the driving sub-circuit 10. To be specific, a high level is applied to the second light-emission control signal input terminal EM2 to turn on the fifth thin film transistor T5, thereby conducting the connection between the second node N2 and the fourth node S, writing the sensing reference voltage $V_{sen-ref}$ into the second node N2, that is, writing the sensing reference voltage $V_{sen-ref}$ into the second terminal of the driving sub-circuit 10.

In this way, the aging detection of the pixel circuit is completed this time, such that when the display device is started next time, an aging compensation may be performed on the pixel electrode according to the result of the aging detection.

At least the following beneficial effects may be achieved in the embodiments of the present disclosure: in the pixel circuit, the method of driving the same, the aging detection method and the display panel in the embodiments of the present disclosure, not only the threshold voltage $V_{th}$ compensation on the driving sub-circuit is performed, but also the aging information detection of the light-emitting element is performed, which facilitates performing the aging compensation on the light-emitting element.

A person skilled in the art may understand that various operations, methods, steps, measures, and solutions in a process that have been discussed in the present disclosure may be alternated, changed, combined, or deleted. Further, the various operations, methods, other steps, measures, and solutions in the process that have been discussed in the present disclosure may also be alternated, changed, rearranged, decomposed, combined, or deleted. Further, various operations, methods, steps, measures, and solutions in the prior art which are the same as those in the present disclosure may also be alternated, changed, rearranged, decomposed, combined or deleted.

It should be appreciated that although the various steps in the flowchart of the drawings are displayed sequentially as indicated by arrows, these steps are not necessarily performed sequentially in an order indicated by the arrows. Unless explicitly stated in the present disclosure, the execution of these steps is not strictly limited to the order, and the steps may be executed in other orders. Moreover, at least part of the steps in the flowchart of the drawings may include multiple sub-steps or multiple stages. These sub-steps or stages are not necessarily executed at the same time, but may be executed at different times, and the order of execution is also not necessarily performed sequentially, but may be performed in turn or alternately with at least part of other steps or sub-steps or stages of other steps.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A pixel circuit, comprising a data written-in sub-circuit, a driving sub-circuit, a threshold compensation sub-circuit, a light-emitting element, a sensing sub-circuit, a first light-emission control sub-circuit and a second light-emission control sub-circuit; wherein the driving sub-circuit comprises a control terminal, a first terminal and a second terminal, and is configured to control a driving current flowing through the first terminal and the second terminal of the driving sub-circuit for driving the light-emitting element to emit light;

the data written-in sub-circuit is connected to a data signal written-in terminal and the control terminal of the driving sub-circuit, and configured to write a reference voltage from the data signal written-in terminal into the control terminal of the driving sub-circuit at a resetting stage of a display process, write threshold compensation information into the second terminal of the driving sub-circuit at a compensation stage of the display process, and write a data signal from the data signal written-in terminal into the control terminal of the driving sub-circuit at a data written-in stage of the display process;

the threshold compensation sub-circuit is connected to the control terminal and the second terminal of the driving sub-circuit, and configured to store the data signal and adjust a voltage at the second terminal of the driving sub-circuit in a coupled manner;

the light-emitting element comprises a first terminal and a second terminal, the first terminal of the light-emitting element is connected to the second terminal of the driving sub-circuit, and the second terminal of the light-emitting element is connected to a second voltage terminal;

the sensing sub-circuit is connected to the first terminal of the light-emitting element and an aging detection device in a display panel, and configured to write a sensing voltage into the first terminal and the second terminal of the driving sub-circuit at the resetting stage of the display process, sense aging information of the light-emitting element during an aging detection process and transmit the aging information to the aging detection device; and the first light-emission control sub-circuit is connected to a first voltage terminal and the first terminal of the driving sub-circuit, and configured to conduct a connection between the first voltage terminal and the first terminal of the driving sub-circuit at a light-emission stage to write a first voltage into the first terminal of the driving sub-circuit, the second light-emission control sub-circuit is connected to the second terminal of the driving sub-circuit and the first terminal of the light-emitting element, and configured to conduct a connection between the second terminal of the driving sub-circuit and the first terminal of the light-emitting element to write the sensing voltage into the first and second terminals of the driving sub-circuit at the resetting stage of the display process, disconnect the second terminal of the driving sub-circuit from the first terminal of the light-emitting element to prevent charges at the second terminal of the driving sub-circuit from leaking to the first terminal of the light-emitting element at the compensation stage and the data written-in stage of the display process, and conduct the connection between the second terminal of the driving sub-circuit and the first terminal of the light-emitting element to enable the driving current to flow to the first terminal of the light-emitting element at the light-emission stage of the display process, the driving sub-circuit comprises a first thin film transistor, the first light-emission control sub-circuit comprises a fourth thin film transistor, the second light-emission control sub-circuit comprises a fifth thin film transistor, the threshold compensation sub-circuit comprises a storage capacitor, a first electrode of the storage capacitor is connected to the gate electrode of the first thin film transistor, and a second electrode of the storage capacitor is directly connected to the second electrode of the first thin film transistor and the first electrode of the fifth thin film transistor, a gate electrode of the fourth thin film transistor is connected to a first light-emission control signal input terminal, a gate electrode of the fifth thin film transistor is connected to a second light-emission control signal input terminal, the first light-emission control signal input terminal is different from the second light-emission control signal input terminal.

2. The pixel circuit according to claim 1, wherein the driving sub-circuit comprises a first thin film transistor, a gate electrode of which is the control terminal of the driving sub-circuit, a first electrode of which is the first terminal of the driving sub-circuit, and a second electrode of which is the second terminal of the driving sub-circuit.

3. The pixel circuit according to claim 1, wherein the data written-in sub-circuit comprises a second thin film transistor, a gate electrode of which is connected to a first scanning signal input terminal, a first electrode of which is connected to the data signal written-in terminal, and a second electrode of which is connected to control terminal of the driving sub-circuit.

4. The pixel circuit according to claim 1, wherein the sensing sub-circuit comprises a third thin film transistor and a sensing line; a gate electrode of the third thin film transistor is connected to a second scanning signal input terminal, a first electrode of the third thin film transistor is connected to a sensing signal input terminal through the sensing line, and a second electrode of the third thin film transistor is connected to the first terminal of the light-emitting element; wherein the sensing line is connected to the aging detection device.

5. The pixel circuit according to claim 1, wherein the threshold compensation sub-circuit comprises a storage capacitor, a first electrode of which is connected to the control terminal of the driving sub-circuit, and a second electrode of which is connected to the second terminal of the driving sub-circuit.

6. The pixel circuit according to claim 1, wherein the first light-emission control sub-circuit comprises a fourth thin film transistor, a gate electrode of which is connected to a first light-emission control signal input terminal, a first electrode of which is connected to the first voltage terminal, and a second electrode of which is connected to the first terminal of the driving sub-circuit.

7. The pixel circuit according to claim 1, wherein the second light-emission control sub-circuit comprises a fifth thin film transistor, a gate electrode of which is connected to a second light-emission control signal input terminal, a first electrode of which is connected to the first terminal of the driving sub-circuit, and a second electrode of which is connected to the second voltage terminal.

8. The pixel circuit according to claim 1, wherein the data written-in sub-circuit comprises a second thin film transistor, the sensing sub-circuit comprises a third thin film transistor and a sensing line, a gate electrode of the first thin film transistor is connected to a second electrode of the second thin film transistor, a first electrode of the first thin film transistor is connected to a second electrode of the fourth thin film transistor, and a second electrode of the first thin film transistor is connected to the first terminal of the light-emitting element;

a gate electrode of the second thin film transistor is connected to a first scanning signal input terminal, a first electrode of the second thin film transistor is connected to the data signal written-in terminal; and a gate electrode of the third thin film transistor is connected to a second scanning signal input terminal, a first electrode of the third thin film transistor is connected to a sensing signal input terminal through the sensing line, and a second electrode of the third thin film transistor is connected to the first terminal of the light-emitting element; wherein the sensing line is connected to the aging detection device.

9. The pixel circuit according to claim 8, wherein a first electrode of the fifth thin film transistor is connected to the first electrode of the first thin film transistor, and a second electrode of the fifth thin film transistor is connected to the second voltage terminal.

10. A display panel, comprising the pixel circuit according to claim 1.

11. The display panel according to claim 10, further comprising the aging detection device, wherein the aging detection device comprises an analog-to-digital converter, a sensing resetting signal input terminal, a first switch tube and a second switch tube, wherein the analog-to-digital converter is connected to the sensing sub-circuit through the first switch tube, and configured to receive the aging information when the first switch tube is turned on;

the sensing resetting signal input terminal is connected to the sensing sub-circuit through the second switch tube, and configured to write a sensing reference voltage into the sensing sub-circuit when the second switch tube is turned on.

12. A method of driving the pixel circuit according to claim 1, comprising:

at the resetting stage, applying, by the data written-in sub-circuit, the reference voltage to the control terminal of the driving sub-circuit, and applying, by the sensing sub-circuit, the sensing voltage to the first terminal and the second terminal of the driving sub-circuit;

at the compensation stage, applying, by the data written-in sub-circuit, the reference voltage to the control terminal of the driving sub-circuit and writing the threshold compensation information to the second terminal of the driving sub-circuit, and applying, by the first light-emission control sub-circuit, the first voltage from the first voltage terminal to the first terminal of the driving sub-circuit;

at the data written-in stage, applying, by the data written-in sub-circuit, the data signal to the control terminal of the driving sub-circuit, and adjusting, by the threshold compensation sub-circuit, the voltage at the second terminal of the driving sub-circuit in accordance with a voltage change amount at the control terminal of the driving sub-circuit in a coupled manner; and at the light-emission stage, enabling the first light-emission control sub-circuit and the driving sub-circuit to be an on state to apply the driving current to the light-emitting element.

13. The method according to claim 12, further comprising:

at the resetting stage, enabling the second light-emission control sub-circuit to an on state to write the sensing voltage into the second terminal of the driving sub-circuit;

at the compensation stage and the data written-in stage, enabling the second light-emission control sub-circuit to be an off state to prevent charges at the second terminal of the driving sub-circuit from leaking to the first terminal of the light-emitting element; and at the light-emission stage, enabling the second light-emission control sub-circuit to be an on state to apply the driving current to the light-emitting element.

14. A method of driving the pixel circuit according to claim 8, comprising:

at the resetting stage, turning on the second thin film transistor under the control of a first scanning signal from the first scanning signal input terminal to write the reference voltage from the data signal written-in terminal into the gate electrode of the first thin film transistor; turning on the third thin film transistor under the control of a second scanning signal from the second scanning signal input terminal to write the sensing voltage from the sensing signal input terminal into the second electrode of the first thin film transistor; turning off the fourth thin film transistor under the control of a first light-emission control signal from the first light-emission control signal input terminal; turning on the first thin film transistor due to a difference between the reference voltage and the sensing voltage being greater than a threshold voltage of the first thin film transistor to write the sensing voltage at the second electrode of the first thin film transistor into the first electrode of the first thin film transistor;

at the compensation stage, turning on the second thin film transistor under the control of the first scanning signal from the first scanning signal input terminal to write the reference voltage from the data signal written-in terminal into the gate electrode of the first thin film transistor and write the threshold compensation information into the second electrode of the first thin film transistor; turning off the third thin film transistor under the control of the second scanning signal from the second scanning signal input terminal; turning on the fourth thin film transistor under the control of the first light-emission control signal from the first light-emission control signal input terminal to write the first voltage from the first voltage terminal into the first electrode of the first thin film transistor; turning off the first thin film transistor due to that the first voltage being greater than the reference voltage;

at the data written-in stage, turning on the second thin film transistor under the control of the first scanning signal from the first scanning signal input terminal to write the data signal from the data signal written-in terminal into the gate electrode of the first thin film transistor; turning off the third thin film transistor under the control of the second scanning signal from the second scanning signal input terminal; turning off the fourth thin film transistor under the control of the first light-emission control signal from the first light-emission control signal input terminal; adjusting, by the storage capacitor, the voltage at the second electrode of the first thin film transistor in accordance with a voltage change amount at the gate electrode of the first thin film transistor in a coupled manner; and at the light-emission stage, turning off the second thin film transistor under the control of the first scanning signal from the first scanning signal input terminal; turning off the third thin film transistor under the control of the second scanning signal from the second scanning signal input terminal; turning on the fourth thin film transistor under the control of the first light-emission control signal from the first light-emission control signal input terminal to write the first voltage from the first voltage terminal into the first electrode of the first thin film transistor; turning on the first thin film transistor to apply the driving current to the light-emitting element.

15. The method according to claim 14, wherein a first electrode of the fifth thin film transistor is connected to the first electrode of the first thin film transistor, and a second electrode of the fifth thin film transistor is connected to the second voltage terminal, the method further comprises:

at the resetting stage, turning on the fifth thin film transistor under the control of a second light-emission control signal to write the sensing voltage into the second electrode of the first thin film transistor;

at the compensation stage and the data written-in stage, turning off the fifth thin film transistor under the control of the second light-emission control signal to prevent charges at the second terminal of the driving sub-circuit from leaking to the first terminal of the light-emitting element; and at the light-emission stage, turning on the fifth thin film transistor under the control of the second light-emission control signal to apply the driving current to the light-emitting element.

16. An aging detection method of the pixel circuit according to claim 1, comprising:

at a resetting stage, writing, by the sensing sub-circuit, a sensing reference voltage applied by an aging sensing device into the second terminal of the driving sub-circuit, and enabling the first light-emission control sub-circuit to be an on state to write the first voltage into the first terminal of the driving sub-circuit;

at a first tracking stage, applying, by the data written-in sub-circuit, the data signal to the control terminal of the driving sub-circuit and writing the threshold compensation information into the second terminal of the driving sub-circuit, and enabling the first light-emission control sub-circuit to be an on state to maintain the first terminal of the driving sub-circuit at the first voltage;

at a second tracking stage, enabling the first light-emission control sub-circuit to be an on state to maintain the first terminal of the driving sub-circuit at the first voltage;

at a sensing stage, enabling the first light-emission control sub-circuit and the driving sub-circuit to an one state to make the light-emitting element to emit light, and sensing, by the sensing sub-circuit, the aging information of the light-emitting element;

at a sampling stage, transmitting, by the sensing sub-circuit, the aging information to the aging detection device; and at a written-back stage, writing, by the data written-in sub-circuit, the reference voltage into the control terminal of the driving sub-circuit, and writing, by the sensing sub-circuit, the sensing reference voltage into the second terminal of the driving sub-circuit.

17. The aging detection method according to claim 16, wherein the aging detection method further comprises:

at the resetting stage, enabling the second light-emission control sub-circuit to be an on state to enable the sensing sub-circuit to write the sensing reference voltage applied by the aging sensing device into the second terminal of the driving sub-circuit;

at the first and second tracking stages, enabling the second light-emission control sub-circuit to be an off state to prevent charges at the second terminal of the driving sub-circuit from leaking to the first terminal of the light-emitting element;

at the sensing stage, enabling the second light-emission control sub-circuit to be an on state to make the light-emitting element to emit light, and sensing, by the sensing sub-circuit, the aging information of the light-emitting element;

at the sampling stage, enabling the second light-emission control sub-circuit to be an on state to make the light-emitting element to emit light, and transmitting, by the sensing sub-circuit, the aging information to the aging detection device; and at the written-back stage, enabling the second light-emission control sub-circuit to an on state to enable the sensing sub-circuit to write the sensing reference voltage into the second terminal of the driving sub-circuit.

18. An aging detection method of the pixel circuit according to claim 8, wherein the aging detection device in the display panel comprises an analog-to-digital converter, a sensing resetting signal input terminal, a first switch tube and a second switch tube, the analog-to-digital converter is connected to the sensing sub-circuit through the first switch tube, and configured to receive the aging information when the first switch tube is turned on; the sensing resetting signal input terminal is connected to the sensing sub-circuit through the second switch tube, and configured to write a sensing reference voltage into the sensing sub-circuit when the second switch tube is turned on, the aging detection method comprises:

at a resetting stage, turning off the first switch tube, turning on the second switch tube, and turning on the third thin film transistor under the control of a second scanning signal to write the sensing reference voltage into the second electrode of the first thin film transistor; turning on the fourth thin film transistor under the control of a first light-emission control signal from the first light-emission control signal input terminal to write the first voltage from the first voltage terminal into the first electrode of the first thin film transistor; and turning off the second thin film transistor under the control of a first scanning signal from the first scanning signal input terminal;

at a first tracking stage, turning on the second thin film transistor under the control of the first scanning signal from the first scanning signal input terminal to write the data signal from the data signal written-in terminal into the gate electrode of the first thin film transistor and write the threshold compensation information into the second electrode of the first thin film transistor; turning off the third thin film transistor under the control of the second scanning signal from the second scanning signal input terminal; turning on the fourth thin film transistor under the control of the first light-emission control signal from the first light-emission control signal input terminal to write the first voltage from the first voltage terminal into the first electrode of the first thin film transistor;

at a second tracking stage, turning off the second thin film transistor under the control of the first scanning signal from the first scanning signal input terminal; turning off the third thin film transistor under the control of the second scanning signal from the second scanning signal input terminal; turning on the fourth thin film transistor under the control of the first light-emission control signal from the first light-emission control signal input terminal to write the first voltage from the first voltage terminal into the first electrode of the first thin film transistor; and a gate-to-source voltage of the first thin film transistor remains unchanged;

at a sensing stage, turning off both the first switch tube and the second switch tube, turning on the fourth thin film transistor under the control of the first light-emission control signal from the first light-emission control signal input terminal, enabling the driving sub-circuit to be an one state to make the light-emitting element to emit light, and turning on the third thin film transistor under the control of the second scanning signal from the second scanning signal input terminal to sense the aging information of the light-emitting element;

at a sampling stage, turning on the first switch tube, turning off the second switch tube, turning on the third thin film transistor under the control of the second scanning signal from the second scanning signal input terminal to transmit the aging information to the analog-to-digital converter; and at a written-back stage, turning off the first switch tube, turning on the second switch tube, turning on the second thin film transistor under the control of the first scanning signal from the first scanning signal input terminal to write the reference voltage into the gate electrode of the first thin film transistor; turning on the third thin film transistor under the control of the second scanning signal to write the sensing reference voltage into the second electrode of the first thin film transistor; turning on the fourth thin film transistor under the control of the first light-emission control signal from the first light-emission control signal input terminal to write the first voltage from the first voltage terminal into the first electrode of the first thin film transistor.

19. The aging detection method according to claim 18, wherein a first electrode of fifth thin film transistor is connected to the first electrode of the first thin film transistor, and a second electrode of fifth thin film transistor is connected to the second voltage terminal, the aging detection method further comprises:

at the resetting stage, turning on the fifth thin film transistor under the control of a second light-emission control signal to write the sensing reference voltage into the second electrode of the first thin film transistor;

at the first tracking stage and the second tracking stage, turning off the fifth thin film transistor under the control of the second light-emission control signal to prevent charges at the second electrode of the first thin film transistor from leaking to the first terminal of the light-emitting element;

at the sensing stage and the sampling stage, turning on the fifth thin film transistor under the control of the second light-emission control signal to enable the light-emitting element to emit light; and at the written-back stage, turning on the fifth thin film transistor under the control of the second light-emission control signal to enable the third thin film transistor to write the sensing reference voltage into the second electrode of the first thin film transistor.

* * * * *